United States Patent [19]

Boegli

[11] Patent Number: 5,007,271

[45] Date of Patent: Apr. 16, 1991

[54] DEVICE AND A METHOD FOR EMBOSSING A METAL FOIL

[76] Inventor: Karl Boegli, Rue des Essertons 2, 2074 Marin, Switzerland

[21] Appl. No.: 593,265

[22] Filed: Oct. 1, 1990

Related U.S. Application Data

[63] Continuation of Ser. No. 651,752, Sep. 18, 1984, abandoned.

[30] Foreign Application Priority Data

Oct. 21, 1983 [EP] European Pat. Off. ..... 83810484.2

[51] Int. Cl.[5] ..... B21D 13/04

[52] U.S. Cl. ..... 72/196; 72/379.2; 156/206

[58] Field of Search ..... 72/196, 197, 372.4; 493/463; 264/286; 425/336, 369; 156/206, 208, 210, 553

[56] References Cited

U.S. PATENT DOCUMENTS

| | | | |
|---|---|---|---|
| 304,417 | 9/1884 | Fletcher | 425/369 |
| 404,741 | 9/1977 | Oser et al. | 72/379 |
| 728,829 | 5/1903 | Arkell | 425/369 |
| 1,018,399 | 2/1912 | Livingston | 72/379 |
| 1,242,698 | 10/1917 | Jacobs | 493/463 |
| 1,571,594 | 2/1926 | Lorenz | 425/336 |
| 1,937,466 | 11/1933 | Smith et al. | 72/196 |
| 1,938,318 | 12/1933 | Colby | 72/71 |
| 2,441,476 | 5/1948 | Ewald | 72/196 |
| 3,335,592 | 8/1967 | Woodling | 72/196 |
| 3,673,839 | 7/1972 | Nielsen et al. | 72/196 |
| 3,712,101 | 1/1973 | Bemrose et al. | 72/196 |
| 4,080,880 | 3/1978 | Shikaya | 493/463 |
| 4,137,744 | 2/1979 | Smick | 72/196 |
| 4,319,473 | 3/1982 | Franke, Jr. et al. | 72/196 |
| 4,600,459 | 7/1986 | Kramer et al. | 156/553 |

FOREIGN PATENT DOCUMENTS

| | | | |
|---|---|---|---|
| 826636 | 1/1952 | Fed. Rep. of Germany | 72/379 |
| 2356243 | 6/1973 | Fed. Rep. of Germany | 72/196 |
| 340747 | 6/1974 | Fed. Rep. of Germany | 72/196 |
| 1540958 | 6/1967 | France | 72/197 |

OTHER PUBLICATIONS

"St. Regis Paper/Steel Foil Laminates a New Stronger, Tougher Packaging Material", by St. Regis Paper Co.; Bulletin #2M864 PD 106, published, Aug. 1964.

*Primary Examiner*—Robert L. Spruill
*Attorney, Agent, or Firm*—Marks Murase & White

[57] ABSTRACT

For embossing a metal foil the same is passed between two similarly toothed rollers positioned so that the teeth of each roller engages the teeth of the other. A high-quality embossing is obtained which may be kept practically constant over long periods of operation. The rollers are mutually synchronized such that only one of these rollers need be coupled with a driving mechanism. The other roller is free and may easily be removed, replaced or adjusted in order to vary the force by which it is pressed against the foil and the driven roller respectively.

11 Claims, 2 Drawing Sheets

DEVICE AND A METHOD FOR EMBOSSING A METAL FOIL

This application is a continuation, of application Ser. No. 06/651,752, filed 09/18/84, now abandoned.

TECHNICAL FIELD

This invention relates to embossing or roughening of a metal foil by passing it between a pair of rotating embossing rollers. Metal foils with a fine regular embossed structure are currently used in the packing industry, particularly for cigarette packages, whereby unembossed areas of the foil which remain smooth may be in the shape of trademarks or written instructions such as "pull" or the like.

BACKGROUND OF THE INVENTION

Usual devices for embossing foils for the purpose mentioned above, comprise one metallic roller having a toothed hardened surface which is urged against a second roller having a smooth soft coating of plastic material into which parts of the foil passed between the rollers are pressed and embossed. However, such devices have a number of drawbacks. The soft coating of the second roller is rapidly worn and has to be frequently replaced and overhauled, a complicated procedure necessitating long shut-down periods of the machine. The embossing of the foil is not fully satisfactory. Further, the rollers have to be driven in accurate synchronism which requires mutual coupling of the rollers by means of separate gears whereby exchange of worn rollers is rendered more complicated. Moreover, the synchronizing gear between the rollers renders adjustment of the mutual position of the rollers complicated or impossible. It is thus difficult or impossible to properly adjust the pressure between the rollers either initially or later during operation of the device to an optimum value.

In some cases the embossing relief of a steel roller is transfered to a roller coated with thermoplastic material for forming thereon a negative of the relief of the steel roller. These rollers are then used together as a pair of rollers for embossing thin metal foils (French patent No. 1,540,958). However, the drawbacks mentioned above similarly apply for this system in which the roller having a coating of thermoplastic material is rapidly worn. When the pair of rollers is used for embossing a foil passing between them, a synchronizing gear has to be provided between the rollers as set out above.

DETAILED DESCRIPTION OF THE INVENTION

An object of the present invention is to provide improved embossing quality and at the same time to simplify the structure and operation of the embossing device. To this end the device preferably comprises a pair of embossing rollers between which a foil may be passed, each roller having similar surface pattern which engages the other. Only one of the rollers is connected to a driving unit, the second roller being driven in synchronism by the driven roller. Preferably both rollers are made of hardened steel or other hard material, whereby mutual synchronization between the rotation of the rollers and a long roller life time is assured. Due to the engagement between of hardened teeth of the rollers, embossing is improved. No synchronizing gear is required, thus permitting a simple suspension design and accordingly easy removal and replacement of the roller which is not connected to external drive means. The roller which is not connected to an external drive means may be easily and rapidly replaced, and due to the long period between succeeding roller replacements, the shut-down periods of the machine are very low compared with the periods of operation and production. Further the roller which is not connected to the external drive means may be adjusted at any time, even during operation, to an optimum position relative to the other roller in order to obtain the best possible embossing quality.

Many of the metal foils to be embossed are coated with paper, and it has been found that the roller contacted by the paper coating of the foil is worn much faster than a similar roller contacted by the metal of the foil. Consequently, the roller which is not connected to the external drive means and which may therefore be easily replaced, preferably is the one which contacts the paper coating of the foil.

This invention will now be explained in more detail with reference to the drawings.

SHORT DESCRIPTION OF THE DRAWINGS

Figure 1:
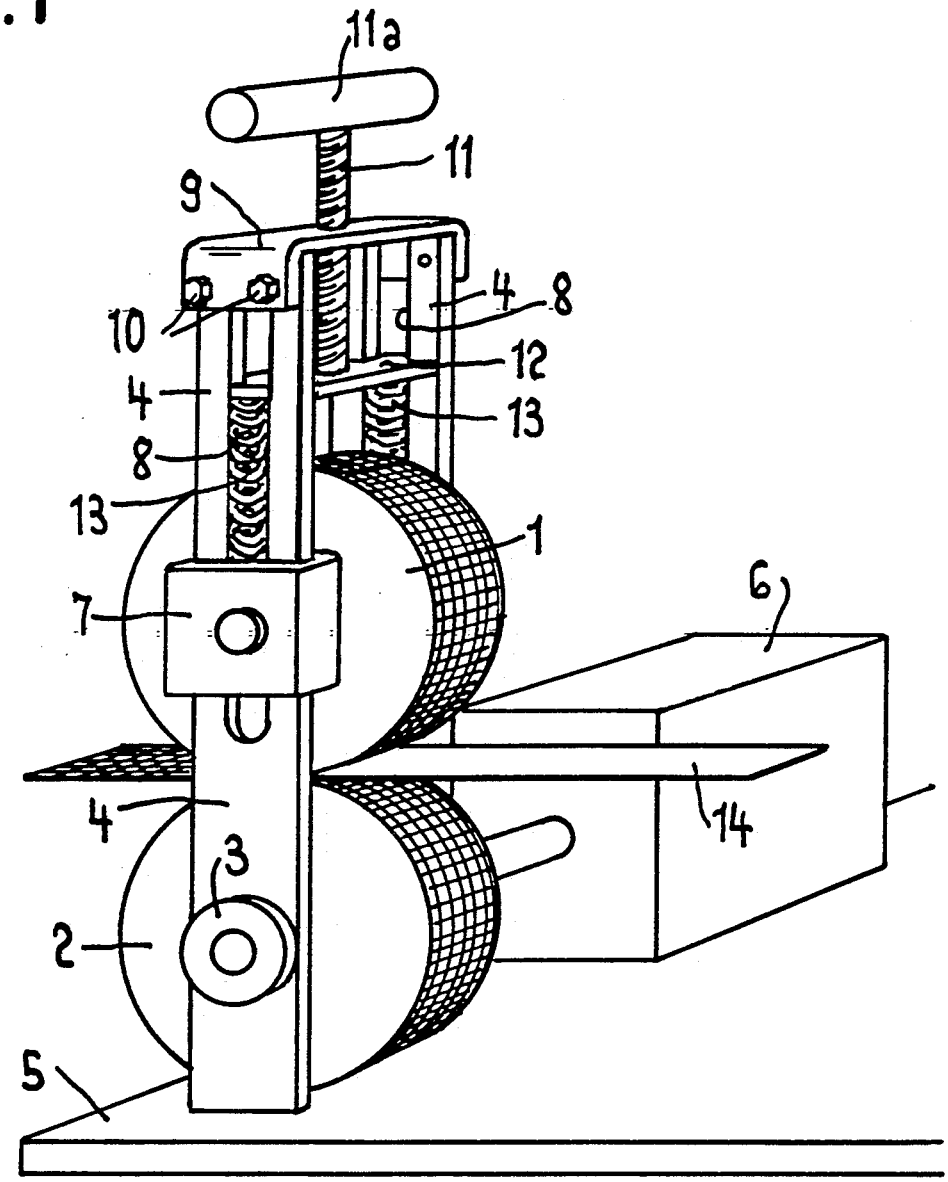
Figure 2:
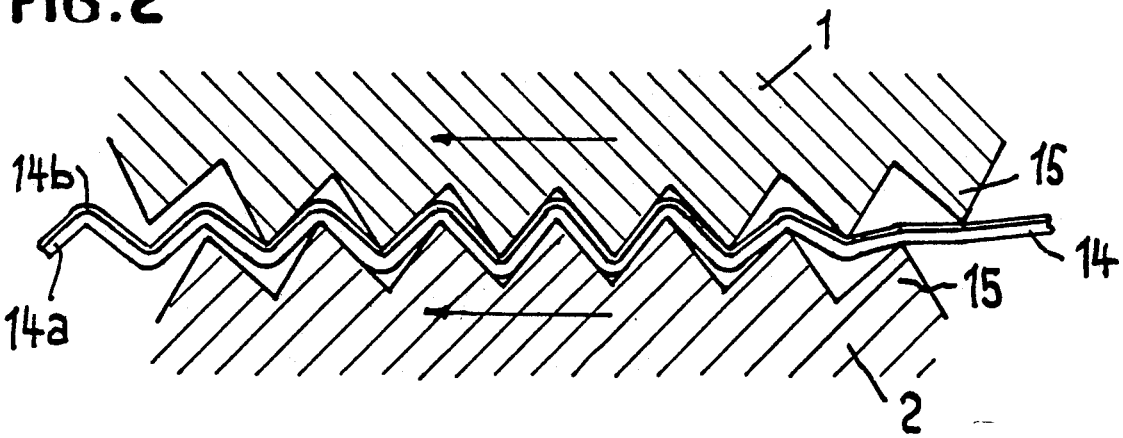
Figure 3:
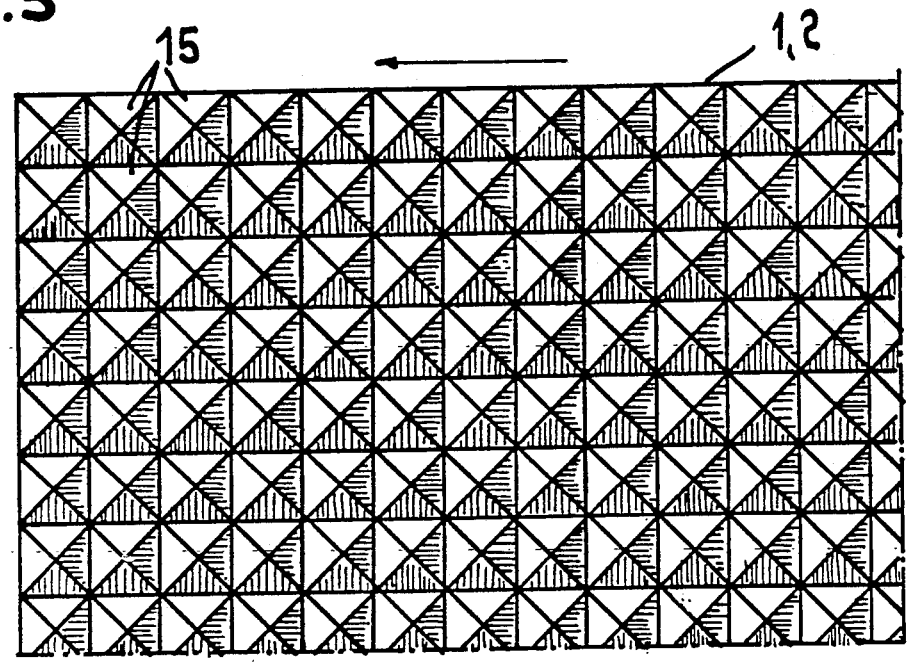
Figure 4:
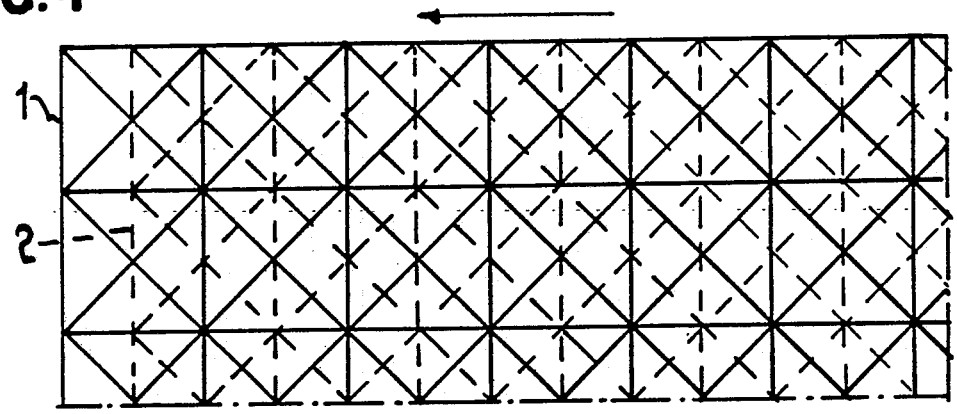
Figure 5:
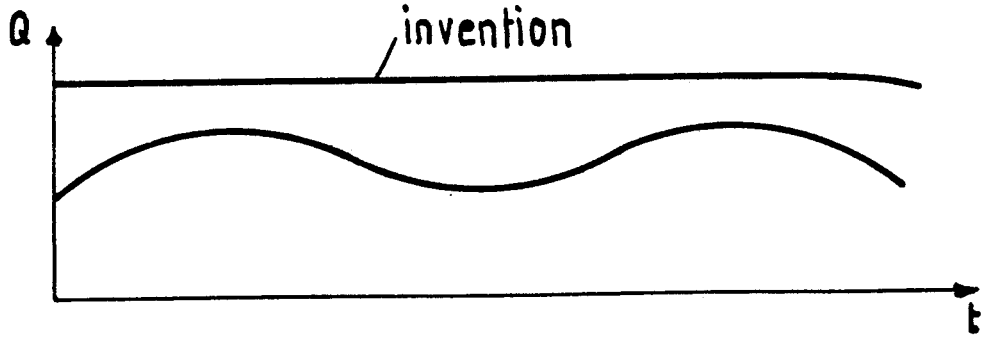

FIG. 1 is a perspective view of an embossing device according to the invention, FIG. 2 is a partial cross section, on an enlarged scale, of the embossing rollers and the foil passing there between, FIG. 3 is a development view of a part of the toothed surface of one of the embossing rollers, FIG. 4 is an enlarged portion of FIG. 3 showing the relative position of the teeth of each of the rollers, and FIG. 5 is a diagram showing the change of embossing quality with time.

BEST MODE OF CARRYING OUT THE INVENTION

The embossing device shown in FIG. 1 has an upper embossing roller 1 and a lower embossing roller 2 which are similar in every respect. Particularly, their diameters are the same and their cylindrical outer surfaces have similar size teeth. The rollers 1 and 2 are preferably made of steel and their toothed surfaces are hardened. The lower roller 2 is rotatably mounted in bearing means 3 on vertical supports 4 mounted on a base plate 5. The lower roller 2 may be driven at an appropriate speed through a gear 6 mounted on the base plate 5.

The upper roller 1 is rotatably mounted in bearing plates 7 slidably mounted on the supports 4, whereby the shaft ends of roller 1 extend through vertical slots 8 of supports 4. The upper ends of supports 4 are interconnected by a top plate 9 removably screwed thereto by means of screws 10. A spindle 11 is mounted in a tap bore of top plate 9 and may be vertically displaced together with an adjusting plate 12 by manually turning its handle 11*a*. A pressure spring 13 is inserted between adjusting plate 12 and each of the bearing plates 7, these springs determining the pressure at which the roller 1 is urged downwardly towards roller 2.

Roller 2 is driven while a foil sheet is inserted between it and roller 1. The pressure between rollers 1 and 2 is adjusted until the roller teeth engage each other for proper embossing of the foil and for synchronously driving roller 1 with roller 2.

During operation a foil tape 14 is passed between the rotating rollers as shown in FIG. 1. As illustrated in FIGS. 2 and 3, each roller has a tooth pattern, comprising for example, an array of pyramid shaped teeth 15 disposed in axial rows, the pitch or distance between adjacent teeth in both a circumferential and axial direction preferably being the same. As an example only, the pitch may be in the order of 0.4 mm and the height of the teeth may be on the order of 0.25 to 0.3 mm. As shown in FIG. 2 the teeth of rollers 1 and 2 engage each other, and the pressure of the upper roller may be so adjusted that the teeth of the rollers engage each other by about 0.15 to 0.20 mm. When the foil 14 passes between the two rotating rollers 1 and 2 a regular embossing pattern as indicated in FIG. 2 is produced on it. It has been found that this embossing pattern has an improved quality compared with prior patterns produced by pairs of a metallic roller and a soft roller.

Due to the engagement of the teeth of rollers 1 and 2, the rotation of roller 1 is properly synchronized with the rotation of the driven roller 2, and no separate synchronizing gear is required. However, the teeth of rollers 1 and 2 should be machined very accurately in order to obtain proper engagement and synchronization between the rollers. From FIG. 2 and 4 it is seen that the teeth of roller 1, shown in full lines, and the teeth of roller 2, shown in dash-dotted lines, are aligned in the circumferential direction or rotating direction as indicated by an arrow, the teeth being staggered in the circumferential direction by a half pitch. This relative position of the teeth results in a perfect coupling and synchronizing effect between the rollers.

As shown in FIG. 2, the foil may consists of a metallic carrier 14*a*, usually of aluminium, which is coated with a paper foil 14*b*. This paper coating 14*b* contacts the upper roller 1. As mentioned above, the upper roller 1 which is contacted by the paper coating, is worn much faster than the lower roller 2 which is contacted by the metallic carrier 14*a* of the foil. As a consequence, the upper roller 1 has to be removed for overhauling and replacement much more often than the lower roller 2. However, since the upper roller 1 is not connected to an external driving gear, removal and replacement of this roller is particularly easy. After removal of the screws 10, the top plate 9 together with spindle 11, adjusting plate 12, springs 13, bearing plates 7 and roller 1 may be shifted upwardly and removed, the slots 8 being open at the upper end of supports 4 and allowing removal of the shaft ends of roller 1. A new roller 1 may then be mounted in bearing plates 7 and slid onto the supports 4. When the whole mechanism is again mounted, the rollers are driven and a foil tape 14 is introduced between the rollers 1 and 2 as shown, whereafter the pressure of roller 1 against roller 2 may be adjusted by means of the handle 11*a* and spindle 11 as explained above, until proper embossing of the foil is obtained. Later, during continuous operation of the embossing device, which may be part of a packing machine, the quality of the embossing may be periodically checked. If the embossing depth and quality decreases due to wear, particularly of roller 1, the pressure of the roller may be increased by means of handle 11*a* and spindle 11 until the desired quality is again obtained. In this way the quality may be maintained practically constant over a relatively long period until roller 1 or both rollers are worn to such an extent that sufficient quality is no longer possible. This is shown in FIG. 5 wherein the upper curve illustrates the quality Q of embossing obtained by this invention, this quality being practically constant over a long time. The lower curve illustrates the quality obtained with an embossing device comprising a metal roller and a roller of soft material. It is seen that the quality is subject to substantial characteristic variations which cannot be avoided by any corrective interventions.

It has been mentioned above that particularly accurate and clean machining of the toothed surfaces of the rollers is required. Since the rows of teeth extend in strictly axial and circumferential directions, the axial grooves between adjacent rows of teeth may be machined by a slotting tool while the circumferential grooves may be machined by turning. However, it may be preferable to machine the roller teeth on the circumference of the rollers by means of a three-dimensional milling machine operating according to a self-generating method. A hard-metal milling cutter may be used preferably having an angle of 40° corresponding to the flange angle of the teeth. Preferably a high-speed milling spindle is used to obtain particularly clean and accurate milling. Different gauges or patterns for control of the cutting operation may be used in accordance with the diameter of the roller to be machined.

It has been found that hardened metal rollers engaging each other for mutual synchronization as described above are largely self-cleaning. This is another advantage of the present invention over prior devices wherein metal dust and small particles used to adhere to the bottom of the roller grooves, necessitating continuous care and cleaning of the rollers.

What is claimed:

1. A device for embossing a delicate metal foil packaging material comprising:

a pair of opposing, embossing rollers, each having a hard, generally cylindrical surface and an array of pointed pyramid-shaped teeth means for embossing the delicate metal foil extending along said surface in both the axial and circumferential directions, the pitch between adjacent teeth being on the order of about 0.4 millimeters and the size of each tooth being on the order of about 0.25 to 0.3 millimeters;

a drive means operatively connected to drive a first of said rollers;

a second of said rollers being displaceably and adjustably mounted opposite said first roller and positioned so that the teeth of the first roller are staggered relative to the teeth of the second roller whereby the teeth of the first roller are operable, when engaged by the opposing teeth of the second roller, to synchronously drive the second roller.

2. The device according to claim 11, wherein the teeth of each roller have a height of on the order of 0.25 to 0.30 mm, and the opposing teeth of the rollers engage each other to a depth of about 0.15 to 0.20 mm.

3. The device according to claim 1, wherein said second roller is pivoted in bearing means mounted for easy removal.

4. The device according to claim 3, wherein said bearing means are slidably mounted in a machine frame, and further comprising means for biasing said bearing means and second roller against said first roller.

5. The device according to claim 4, wherein said bearing means are slidably mounted in open slots in said machine frame from which they may be easily removed.

6. The device according to claim 4, wherein said biasing means comprises a spring disposed between said bearing means and a spring supporting means, said spring supporting means being adjustable in the direction of said bias for adjusting the force exerted by said spring.

7. The device according to claim 1, wherein both rollers are of similar material and have hardened toothed surfaces.

8. A method of embossing delicate foil material by passing said foil between a pair of embossing rollers, comprising the steps of:

providing a pair of embossing rollers, each having a similar surface tooth pattern comprising an axial and circumferential array of pointed, pyramid-shaped teeth, driving a first of said pair of rollers;

inserting said metal foil between the rollers; and adjusting the pressure exerted by a second of said rollers against said first roller until the teeth of said tooth pattern of said rollers engage each other for properly embossing said foil and for synchronously driving said second roller by said first roller.

9. The method according to claim 8, wherein the step of adjusting further comprises the step of increasing the pressure exerted by said second roller against said first roller whenever the embossing depth of said foil becomes insufficient.

10. The method of claim 9 wherein said step of increasing is performed while said first roller is being driven and said foil is being embossed.

11. The method of claim 8 wherien said metal foil has a paper backing and said step of inserting further comprises inserting said metal foil between said rollers with said paper backing facing said second roller; and further comprising the step of replacing said second roller when worn by contact with said paper backing.

* * * * *